United States Patent [19]

Glanz et al.

[11] Patent Number: 4,520,379

[45] Date of Patent: May 28, 1985

[54] THERMALLY-RESPONSIVE RECORD MATERIAL

[75] Inventors: Kenneth D. Glanz; Troy E. Hoover, both of Appleton, Wis.

[73] Assignee: Appleton Papers Inc., Appleton, Wis.

[21] Appl. No.: 620,997

[22] Filed: Jun. 15, 1984

[51] Int. Cl.[3] ..... B41M 5/18

[52] U.S. Cl. ..... 346/214; 346/216; 346/217; 346/221; 346/225; 427/150; 427/151

[58] Field of Search ..... 346/214, 216, 217, 221, 346/225; 427/150, 151

[56] References Cited

U.S. PATENT DOCUMENTS 4,436,783 3/1984 Okumura et al. ..... 428/913

FOREIGN PATENT DOCUMENTS 45093 3/1982 Japan ..... 346/216

*Primary Examiner*—Bruce H. Hess

*Attorney, Agent, or Firm*—E. Frank McKinney; Paul S. Phillips, Jr.

[57] ABSTRACT

A thermally-sensitive color-forming composition is disclosed which comprises chromogenic material and certain acidic developer material. Record material comprising this color-forming composition exhibits substantially improved performance in certain Group 3 facsimile equipment.

12 Claims, No Drawings

THERMALLY-RESPONSIVE RECORD MATERIAL

This invention relates to thermally-responsive record material. It more particularly relates to such record material in the form of sheets coated with color-forming systems comprising chromogenic material and acidic color developer material. This invention particularly concerns a thermally-responsive record material with improved color-forming sensitivity and/or image density.

Thermally-responsive record material systems are well known in the art and are described in many patents, for example U.S. Pat. Nos. 3,539,375; 3,674,535; 3,746,675; 4,151,748; 4,181,771; and 4,246,318 which are hereby incorporated by reference. In these systems, basic chromogenic material and acidic color developer material are contained in a coating on a substrate which, when heated to a suitable temperature, melts or softens to permit said materials to react, thereby producing a colored mark.

In the field of thermally-responsive record material, thermal sensitivity (response) is defined as the temperature at which a thermally-responsive record material produces a colored image of sufficient intensity (density). The desired temperature of imaging varies with the type of application of the thermally-responsive product and the equipment in which the imaging is to be performed. The ability to shift the temperature at which a satisfactorily intense thermal image is produced for any given combination of chromogenic material and developer material is a much sought after and very valuable feature.

Also in the field of thermally-responsive record material, the ability to increase the efficiency of the thermal image formation process has decided advantages. Principal among these are the ability to obtain the same image intensity with a lower amount of reactants or, alternatively, to obtain a more intense image with the same amount of reactants.

One of the uses for thermally-responsive record material which is enjoying increasing importance is facsimile reproduction. Alternative terms for facsimile are telecopying and remote copying. In the facsimile system, images transmitted electronically are reproduced as hard copy. The trend in facsimile equipment is towards shorter transmission times and higher resolution of the facsimile-produced image. This trend requires thermally-responsive record material with increased sensitivity.

Increases in the sensitivity of thermally-responsive record material have been achieved through the incorporation of a phenylhydroxynaphthoate compound or a hydroxyanilide compound in the color-forming composition along with the chromogenic material and developer material as disclosed in co-pending application Ser. No. 478,199 or Ser. No. 607,558, respectively, by Kenneth D. Glanz, one of the inventors herein.

Another means of achieving increased sensitivity is presented in U.S. Pat. No. 4,436,783 which discloses thermosensitive recording material containing as the color developer a fused mixture comprising a bisphenol compound and another phenolic compound, wherein the fused mixture has a melting point lower than that of the bisphenol compound. Included in the examples of the eligible bisphenol compounds is the general formula

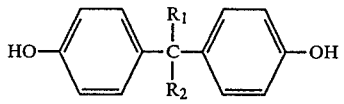

wherein $R_1$ and $R_2$ each represents a methyl group, ethyl group, propyl group, butyl group, pentyl group, $—COOR_3$, or $—CH_2—CH_2—COOR_3$ (where $R_3$ represents a hydrogen atom, a lower alkyl group of 1 to 5 carbon atoms, phenyl group, or benzyl group). There is no disclosure or suggestion in U.S. Pat. No. 4,436,783 that $R_3$ can be alkene or alkyne radicals. This patent further states that for thermosensitive recording material to be used in higher speed facsimile equipment, no single color developer of desirable overall characteristics has ever been found.

Applicants have discovered, unexpectedly, that a thermally-responsive record material employing a color-forming composition comprising chromogenic material and, as a color developer, an alkenyl or alkynyl ester of 4,4-bis-(4-hydroxyphenyl)pentanoic acid produces a sensitivity satisfactory for certain Group 3 facsimile machines without the need for resorting to sensitivity enhancing techniques or materials.

It is an object of the present invention to provide a thermally-responsive recording material having improved thermal sensitivity.

It is also an object of the present invention to provide a thermally-responsive recording material having an enhanced image intensity.

It is likewise an object of the present invention to provide a thermally-responsive record material comprising a support member bearing a thermally-sensitive color-forming composition comprising chromogenic material and, as developer material, an alkenyl or alkynyl ester of 4,4-bis(4-hydroxyphenyl)-pentanoic acid in contiguous relationship, whereby the melting or sublimation of either material produces a change in color by reaction between the two and a suitable binder therefor.

It is yet another object of the present invention to provide a thermally-responsive record material comprising a support member bearing a thermally-sensitive color-forming composition comprising chromogenic material and acidic developer material selected from the group consisting of allyl-4,4-bis(4-hydroxyphenyl)pentanoate and propargyl-4,4-bis(4-hydroxyphenyl)pentanoate in contiguous relationship, whereby the melting or sublimation of either material produces a change in color by reaction between the two.

In accordance with the present invention, it has been found that these and other objectives may be attained by employing a thermally-sensitive color-forming composition comprising chromogenic material and acidic developer material selected from the group consisting of allyl-4,4-bis(4-hydroxyphenyl)pentanoate and propargyl-4,4-bis(4-hydroxyphenyl)pentanoate and binder material. The surprising feature of this composition is that the composition possesses improved thermal sensitivity and increased efficiency of thermal image formation.

The color-forming composition (or system) of the record material of this invention comprises chromogenic material in its substantially colorless state and acidic developer material. The color-forming system relies upon melting or subliming of one or more of the components to achieve reactive, color-producing contact.

The record material includes a substrate or support material which is generally in sheet form. For purposes of this invention, sheets also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The gist of this invention resides in the color-forming composition coated on the substrate. The kind or type of substrate material is not critical.

The components of the color-forming system are in a contiguous relationship, substantially homogeneously distributed throughout the coated layer material deposited on the substrate. In manufacturing the record material, a coating composition is prepared which includes a fine dispersion of the components of the color-forming system, polymeric binder material, surface active agents and other additives in an aqueous coating medium. The composition can additionally contain inert pigments, such as clay, talc, aluminum hydroxide, calcined kaolin clay and calcium carbonate; synthetic pigments, such as urea-formaldehyde resin pigments; natural waxes such as Carnuba wax; synthetic waxes; lubricants such as zinc stearate; wetting agents and defoamers.

The color-forming system components are substantially insoluble in the dispersion vehicle (preferably water) and are ground to an individual average particle size of between about 1 micron to about 10 microns, preferably about 3 microns. The polymeric binder material is substantially vehicle soluble although latexes are also eligible in some instances. Preferred water-soluble binders include polyvinyl alchol, hydroxy ethylcellulose, methylcellulose, hydroxypropylmethylcellulose, starch, modified starches, gelatin and the like. Eligible latex materials include polyacrylates, polyvinylacetates, polystyrene, and the like. The polymeric binder is used to protect the coated materials from brushing and handling forces occasioned by storage and use of the thermal sheets. Binder should be present in an amount to afford such protection and in an amount less than will interfere with achieving reactive contact between color-forming reactive materials.

Coating weights can effectively be about 3 to about 9 grams per square meter (gsm) and preferably about 5 to about 6 gsm. The practical amount of color-forming materials is controlled by economic considerations, functional parameters and desired handling characteristics of the coated sheets.

Eligible chromogenic compounds, such as the phthalide, leucauramine and fluoran compounds, for use in the color-forming system are well known color-forming compounds. Examples of the compounds include Crystal Violet Lactone [3,3-bis(4-dimethylaminophenyl)-6-dimethylaminophthalide (U.S. Pat. No. Re. 23,024)]; phenyl-, indol-, pyrrol-, and carbazol-substituted phthalides (for example, in U.S. Pat. Nos. 3,491,111; 3,491,112; 3,491,116; 3,509,174); nitro-, amino-, amido-, sulfon amido-, aminobenzylidene-, halo-, anilino-substituted fluorans (for example, in U.S. Pat. Nos. 3,624,107; 3,627,787; 3,641,011; 3,642,828; 3,681,390); spirodipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are: 3-diethylamino-6-methyl-7-anilino-fluoran (U.S. Pat. No. 3,681,390); 3-diethylamino-6-methyl-7-(2',4'-dimethylanilino)fluoran (U.S. Pat. No. 4,330,473; 7-(1-ethyl-2-methylindol-3-yl)-7-(4-diethylamino-2-ethoxyphenyl)-5,7-dihydrofuro[3,4-b]pyridin-5-one (U.S. Pat. No. 4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl)-7-(4-diethylamino-2-ethoxyphenyl)-5,7-dihydrofuro[3,4-b]pyridin-5-one; 3-diethylamino-7,8-benzofluoran; 3,3-bis(1-ethyl-2-methylindol-3-yl)phthalide; 3-diethylamino-7-anilinofluoran; 3-diethylamino-7-benzylaminofluoran; 3'-phenyl-7-dibenzylamino-2,2'-spiro-di[2H-1-benzopyran]; and mixtures of any two or more of the above.

The following examples are given to illustrate some of the features of the present invention and should not be considered as limiting. In these examples all parts are by weight, all solutions are in water and all measurements are in the metric system, unless otherwise stated.

The developer materials of the present invention were made by the following procedures:

Preparation of allyl-4,4-bis(4-hydroxyphenyl)pentanoate

A mixture of 85.8 grams of 4,4-bis-(4-hydroxyphenyl)pentanoic acid, 200 ml. of allyl alcohol and 2 ml. of concentrated sulfuric acid was heated to 50° C. and maintained at the temperature, with stirring, for 20 hours. The mixture was then poured into 1500 ml. of water, with stirring. The oily layer was allowed to settle and the aqueous layer was removed by decantation. The oily layer was washed with water two additional times. Finally, a 1500 ml. portion of water was added to the oil and the mixture was stirred until the viscous oil solidified. The solid was separated from the water, pulverized and stirred one hour with 1000 ml. of water containing 16.8 grams of sodium bicarbonate. The product was filtered and washed with water until the filtrate was neutral. Yield: 86.6 grams (88.5%) of off white solid, m.p. 83°–85° C.

Preparation of propargyl-4,4-bis-(4-hydroxyphenyl)pentanoate

A mixture of 21.2 grams of 4,4-bis(4-hydroxyphenyl)-pentanoic acid, 50 ml. of propargyl alcohol and 0.3 ml. of concentrated sulfuric acid was stirred at room temperature for 40 hours. The mixture was then poured into 500 ml. of water, with stirring. The oily layer was allowed to settle and the aqueous layer was removed by decantation. The oily layer was washed with water two additional times. Finally, 500 ml. of water containing 10 grams of sodium bicarbonate was added to the oily layer, the product was extracted from the mixture into ether and chromatographed on a silica column (using 10/90 acetone/toluene, by volume, eluent) to give 96.9 grams (41%) of white solid, m.p. 99.5°–101.0° C.

In all examples illustrating the present invention a dispersion of a particular system component was prepared by milling the component in an aqueous solution of the binder until a particle size of between about 1 micron and 10 microns was achieved. The milling was accomplished in an attritor or other suitable dispersing device. The desired average particle size was about 3 microns in each dispersion.

In these examples separate dispersions comprising the chromogenic compound (Component A) and the acidic developer material (Component B) were prepared.

| Material | Parts |
|---|---|
| Component A | |
| Chromogenic compound | 39.10 |
| Binder, 20% polyvinyl alcohol in water | 28.12 |
| Water | 45.00 |
| Defoamer & dispersing agent* | 0.28 |
| Surfynol 104, 5% solution in isopropyl alcohol | 12.00 |
| Component B | |
| Acidic developer material | 13.60 |
| Binder, 10% polyvinyl alcohol in water | 24.00 |
| Water | 42.35 |
| Defoamer & dispersing agent* | 0.05 |

*Equal parts of the defoamer Nopko NDW (sulfonated caster oil produced by Nopko Chemical Company) and the dispersing agent Surfynol 104 (a di-tertiary acetylene glycol surface active agent producted by Air Products and Chemicals Inc.) were employed.

The chromogenic compound employed in the examples was 3-diethylamino-6-methyl-7-anilinofluoran.

The acidic developer materials employed in the examples are listed in Table 2.

TABLE 2

| Acidic Developer Compound | Designation of Dispersion Comprising said Developer Compound |
|---|---|
| allyl-4,4-bis(4-hydroxyphenyl)pentanoate | B-1 |
| propargyl-4,4-bis(4-hydroxyphenyl)pentanoate | B-2 |
| n-propyl-4,4-bis(4-hydroxyphenyl)pentanoate | B-3 |

Mixtures of Dispersion A and B and the ingredients listed in Table 3 were made:

TABLE 3

| Components | Parts, Wet |
|---|---|
| Dispersion A | 0.6 |
| Dispersion B | 6.6 |
| Urea-formaldehyde resin pigment | 0.6 |
| Styrene-butadiene latex, 50% solids | 0.6 |
| Zinc stearate dispersion, 21% solids | 1.4 |
| Paraffin emulsion, 30% solids | 0.1 |
| Methylcellulose solution, 10% solids | 0.6 |
| Water | 5.1 |

The mixture of Table 3 was applied to paper and dried, yielding a dry coat weight of about 5.2 to about 5.9 gsm.

The resulting thermally-responsive record material examples were imaged in an Omnifax model G-96 Group 3 facsimile machine sold by Teleautograph Corp., 8700 Bellanca Avenue, Los Angeles, CA 90045. In this imaging test a Teleautograph Facsimile Test Sheet was employed. The test sheet has a variety of types and densities of images. After imaging each of the three examples in the Teleautograph equipment, the reflectance intensity was measured in three corresponding areas of each test sheet. The data of Area 3 was an average of two readings in each instance. The intensity of each image was measured by means of a reflectance reading using a Bausch & Lomb Opacimeter. A reading of 100 indicates no discernable image and a low value indicates good image development. The intensity of the image of each Example is presented in Table 4.

TABLE 4

| Example | Developer Dispersion | Reflectance Intensity Area 1 | Area 2 | Area 3 |
|---|---|---|---|---|
| 1 | B-1 | 4.8 | 6.6 | 5.6 |
| 2 | B-2 | 6.8 | 6.9 | 6.7 |
| 3 | B-3 | 30.0 | 33.3 | 30.0 |

From the data of Table 4 it is readily apparent that thermally-responsive recording materials comprising the developer materials of the present invention produce substantially enhanced image intensities compared to corresponding thermally-responsive recording material comprising previously known developer material.

The invention being thus described, it will be obvious that the same may be varied in many ways. Such variations are not to be regarded as a departure from the spirit and scope of the invention, and all such modifications are intended to be included within the scope of the following claims.

What is claimed:

1. A thermally-responsive record material comprising a support member bearing a thermally-sensitive color-forming composition comprising chromogenic material and acidic developer material selected from the group consisting of allyl-4,4-bis(4-hydroxyphenyl)pentanoate and propargyl-4,4-bis(4-hydroxyphenyl)pentanoate in contiguous relationship, whereby the melting or sublimation of either material produces a change in color by reaction between the two, and a suitable binder therefor.

2. The record material of claim 1 in which the acidic developer material is allyl-4,4-bis(4-hydroxyphenyl)-pentanoate.

3. The record material of claim 1 in which the chromogenic material is selected from the group consisting of 3-diethylamino-6-methyl-7-anilinofluoran; 7-(1-ethyl-2-methylindol-3-yl)-7-(4-diethylamino-2-ethoxy-phenyl)-5,7-dihydrofuro[3,4-b]pyridin-5-one; 3-diethylamino-7-(2-chloroanilino)fluoran; 3-(N-methylcyclohexylamino)-6-methyl-7-anilinofluoran; 7-(1-octyl-2-methylindol-3-yl)-7-(4-diethylamino-2-ethoxyphenyl)-5,7-dihydrofuro[3,4-b]pyridin-5-one; 3'-phenyl-7-dibenzylamino-2,2'-spirodi-[2H-1-benzopyran]; 3,3-bis(4-dimethylaminophenyl)-6-dimethylaminophthalide and mixtures thereof.

4. The record material of claim 3 in which the chromogenic material is 3-diethyalmino-6-methyl-7-anilinofluoran.

5. The record material of claim 1 or 4 in which the binder is selected from the group consisting of polyvinyl alcohol, methylcellulose, hydroxypropylmethylcellulose, starch, hydroxyethylcellulose, styrene-butadiene latex and mixtures thereof.

6. The record material of claim 5 in which the binder is selected from the group consisting of polyvinyl alcohol, methylcellulose, styrene-butadiene latex and mixtures thereof.

7. The record material of claim 6 in which the binder is a mixture of polyvinyl alcohol, methylcellulose and styrene-butadiene latex.

8. A thermally-responsive record material comprising a support member bearing a thermally-sensitive color-forming composition comprising chromogenic material selected from the group consisting of 3-diethylamino-6-methyl-7-anilinofluoran; 7-(1-ethyl-2-methylindol-3-yl)-7-(4-diethylamino-2-ethoxyphenyl)-5,7-dihydrofuro[3,4-b]pyridin-5-one; 3,3-bis(4-dimethylaminophenyl)-6-dimethylaminophthalide and mixtures thereof and acid developer material consisting of allyl-4,4-bis(4-hydroxyphenyl)pentanoate in contiguous relationship, whereby the melting or sublimation of either material produces a change in color by reaction between the two, and a suitable binder therefor.

9. The record material of claim 8 in which the chromogenic material is 3-diethylamino-6-methyl-7-anilinofluoran.

10. The record material of claim 8 in which the binder is selected from the group consisting of polyvinyl alcohol, methylcellulose, hydroxypropylmethylcellulose, starch, hydroxyethylcellulose, styrene-butadiene latex and mixtures thereof.

11. The record material of claim 10 in which the binder is selected from the group consisting of polyvinyl alcohol, methylcellulose, styrene-butadiene latex and mixtures thereof.

12. The record material of claim 11 in which the binder is a mixture of polyvinyl alcohol, methylcellulose and styrene-butadiene latex.

* * * * *

UNITED STATES PATENT AND TRADEMARK OFFICE

CERTIFICATE OF CORRECTION

PATENT NO. : 4,520,379

DATED : May 28, 1985

INVENTOR(S) : Kenneth D. Glanz et al.

It is certified that error appears in the above-identified patent and that said Letters Patent are hereby corrected as shown below:

Claim 4, line 48, change
"3-diethyalmino-6-methyl-7-anilino-"

to

--3-diethylamino-6-methyl-7-anilino- --.

Signed and Sealed this

*Twelfth* Day of *November 1985*

[SEAL]

*Attest:*

DONALD J. QUIGG

*Attesting Officer*

*Commissioner of Patents and Trademarks*